United States Patent [19]

Beyer et al.

[11] Patent Number: 4,509,993

[45] Date of Patent: Apr. 9, 1985

[54] REGENERATION AGENT FOR CARBURIZATION SALT BATH

[75] Inventors: Hans-Hermann Beyer, Kahl; Ulrich Baudis, Hanau; Peter Biberbach, Rodenbach, all of Fed. Rep. of Germany

[73] Assignee: Degussa Aktiengesellschaft, Frankfurt am Main, Fed. Rep. of Germany

[21] Appl. No.: 566,811

[22] Filed: Dec. 29, 1983

[30] Foreign Application Priority Data

Jan. 8, 1983 [DE] Fed. Rep. of Germany ..... 3300488

[51] Int. Cl.[3] ..... C21D 1/48

[52] U.S. Cl. ..... 148/15.5; 148/28; 148/27; 148/30; 528/257

[58] Field of Search ..... 528/257; 148/28, 30, 148/27, 15.5

[56] References Cited

U.S. PATENT DOCUMENTS

| | | | |
|---|---|---|---|
| 3,303,063 | 2/1967 | Pietryka | 148/15.5 |
| 3,847,597 | 11/1974 | Mueller et al. | 148/15.5 |
| 4,006,043 | 2/1977 | Gaucher et al. | 148/15.5 |
| 4,019,928 | 4/1977 | Beyer et al. | 148/15.5 |

FOREIGN PATENT DOCUMENTS

| | | | |
|---|---|---|---|
| 103581 | 4/1938 | Australia | 148/15.5 |
| 2310815 | 9/1974 | Fed. Rep. of Germany . | |
| 2409285 | 9/1975 | Fed. Rep. of Germany . | |
| 379764 | 9/1932 | United Kingdom | 148/15.5 |
| 697603 | 11/1979 | U.S.S.R. | 148/15.5 |
| 775170 | 10/1980 | U.S.S.R. | 148/15.5 |

*Primary Examiner*—Veronica O'Keefe

*Attorney, Agent, or Firm*—Cushman, Darby & Cushman

[57] ABSTRACT

It is known to regenerate salt baths for nitriding parts of iron and steel with polymers of organic materials, which polymers, however, could not be used in carburizing salt baths since with them there only are formed slight amounts of carburizing active cyanide, the baths foam, and carbon residues are formed. An excellent regeneration agent for carburizing salt baths is obtained by using polymeric organic compounds of the overall composition $[C_6H_xN_y]_z$ where x is 3 to 5, y is 5 to 8, and z is 10 to 10,000. These compounds are obtained by reacting formaldehyde with cyanamide and/or dicyandiamide and/or melamine and pyrolytically decomposing the reaction product at 300° to 600° C.

9 Claims, No Drawings

REGENERATION AGENT FOR CARBURIZATION SALT BATH

BACKGROUND OF THE INVENTION

The invention is directed to a regeneration agent for salt baths for the carburization of iron and steel parts, the regeneration agent being in the form of polymeric organic compounds and a process for their production.

Salt baths for the carburization of iron and steel parts in the hardening art generally consist of a mixture of alkali cyanide (e.g., sodium cyanide or potassium cyanide) as the active carburization material, barium chloride as the carrier melt, and alkali carbonate (e.g., sodium carbonate and potassium carbonate). They are operated at a temperature of 800° to 950° C. At this temperature, carbon preferentially diffuses into the surface of the workpieces hung for about 1 to 5 hours in the melt. By subsequent quenching of the carburized workpieces, there is produced a high edge or boarder hardness and high resistance to wear. However, during the operation of the salt bath, there occurs a gradual oxidation of the cyanide by the oxygen of the air to carbonate, which is inactive for the carburization process.

Because the baths become inactive through this, until now the original bath composition must again be produced from time to time by addition of cyanide or cyanide containing salt mixtures. For each regeneration, a part of the salt must be carried out of the bath and discarded as highly toxic salt. This method of operation, however, has the disadvantage that highly toxic waste salt must be discarded and the toxic cyanide must be stored as regeneration agent. Therefore, it has already been proposed (German Pat. No. 2310815 and related Beyer U.S. Pat. No. 4,019,928) to use for the regeneration of salt baths for the nitriding of workpieces polymeric triazine compounds, polymeric hydrocyanic acid, and polymeric carboxylic acid amides (German Pat. No. 2409285). These additives have the advantage that they are nontoxic. In principle, they are also usable for carburization. With addition of these compounds, the carbonate formed in the salt bath crucible through the oxidation and unsuitable for the carburization itself is changed back into carburization active cyanide. In this manner of operation, therefore, there is eliminated the draining of waste salts and the storage of cyanide.

However, the above-mentioned regeneration agent in practice is employed preponderantly only for the regeneration of nitriding salt baths at temperatures of around 580° C. In the use of this material for the regeneration of carburizing baths at 800° to 950° C., there occur a series of disadvantages, which until now have prevented their employment in that art.

Thus, in using melon or polymers derived from urea, there are produced only small amounts of the carburizing active cyanide, and instead large amounts of cyanate which only partially and slowly decomposes to cyanide and is undesired in carburizing salt baths because it negatively influence the carburization action and leads to edge oxidation on the steel. Besides through the decomposition of the cyanate at the high temperatures of the carburizing baths, there occurs a strong foaming of the salt bath which can lead to overflowing of the melt. Furthermore, the reaction of this regeneration agent with the melt proceeds extremely vigorously.

In using the known polymeric hydrocyanic acid (azulminic acid), indeed the above difficulties occur only to a limited extent. However, instead there arise other problems. Thus, azulminic acid in the reaction with carbonate forms in addition to cyanide considerable amounts of carbon through which there is built up a dense bath covering which increases the difficulty of the regeneration. The yield of cyanide is, therefore, unsatisfactory. Besides, the production of the polymeric hydrocyanic acid requires extensive safety procedures and great apparatus expense since it must start from the highly toxic hydrogen cyanide.

Therefore, it was the problem of the present invention to find regeneration agents in the form of polymeric organic compounds for salt baths for carburizing iron and steel parts, which agents effect a practically complete conversion of carbonate into cyanide, cause no excess foaming of the salt bath, form no carbon residues, and are safe to produce.

SUMMARY OF THE INVENTION

This problem was solved according to the invention by making polymeric organic compounds and using them as regenerating agents for carburizing salt baths. The polymeric organic compounds have the overall composition $[C_6H_xN_y]_z$ where x is 3 to 5, y is 5 to 8, and z is 10 to 10,000. Besides, the material can still contain up to 1% oxygen in bound form.

The carburizing baths employed are the conventional ones such as those of the type mentioned above.

Preferably, there are used compounds of the composition $[C_6H_3N_7]_z$ where z is 10 to 10,000. Especially preferred have proven polymers where z is between 100 and 1000. Thereby, the exact determination of z, however, is very difficult. Therefore, it is possible that even compounds having other z values can also be well to employ.

These polymeric compounds react with the carbonate in the carburization bath in quiet reaction and with very good yields to form cyanide, whereby there are formed neither carbon residues nor disturbing cyanate portions.

The polymeric regeneration agents of the invention therewith make possible a problem-free regeneration of carburizing salt baths. Thereby, the good carburizing action of these baths is not injured through the regeneration.

The regeneration agent for carburizing salt baths of the invention is advantageously produced by reaction of about 6 moles of formaldehyde with 3 moles of dicyandiamide or 6 moles of cyanamide or 2 moles of melamine or corresponding mixtures of these compounds at a temperature of 300° to 600° C., with subsequent pyrolysis treatment of the resinous condensation products with exclusion of oxygen in the same temperature range. Preferably, formaldehyde is employed in the form of solid paraformaldehyde, and the pyrolysis is carried out in a nitrogen atmosphere.

The overall composition of the thus obtained regeneration agent can be changed by variation of the pyrolysis conditions (time and temperature of pyrolysis) and by variation of the mixing proportions of the starting materials. Preferably, the reaction and pyrolysis are carried out at 400° to 500° C. during a time of 10 to 60 minutes. The addition of formaldehyde can be varied in the range of 5 to 7 moles.

There has proven particularly suitable the reaction product of 2 moles of paraformaldehyde with 1 mole of dicyandiamide at a pyrolysis temperature of 400° C. and a time of pyrolysis of 30 minutes. Hereby, first with splitting off of water, there is formed the known resinous-adhesive white dicyandiamide-formaldehyde condensation products (see R. Wegler and H. Herlinger in Houben-Weyl, Vol. 14/2 Makromolekulare Stoffe II, pages 382 et seq., Stuttgart 1963 (the entire disclosure of which is hereby incorporated by reference and relied upon)) which is further reacted at the pyrolysis temperatures with the splitting off of steam, ammonia, hexamethylentetramine, and small amounts of hydrocyanic acid to a black polymerizate of the composition $[C_6H_3N_7]_z$ where z is 10 to 10,000.

The polymerizate is a deep black substance which is practically insoluble in the available solvents. It has no optically recognizable melting point and decomposes slowly and exothermically in the air at a temperature above 610° C.

The properties of the material do not permit a clear ascertaining of the structure with the available analytical methods. The overall composition and the mentioned properties of the material, especially the insolubility and the black color as well as the splitting off of hexamethylenetetramine, ammonia, water, and traces of hydrocyanic acid in the production, however, show that the compounds of the invention must have a completely different structure than the white and water soluble formaldehyde resins occurring as the intermediate products.

The advantages of the regeneration agent of the invention in comparison to the substances melon and polymers of hydrocyanic acid are shown in the following table. For this purpose, the same amount by weight of regeneration agent are given in commercial carburization salt baths which were in operation a long time and still contained 9.0% cyanide and 0% cyanate. The increase of the cyanide and cyanate values were measured 5 minutes after addition of the regeneration agent.

TABLE

| Regenerating Agent | Melon | Polymeric Hydrogen Cyanide $(HCN)_x$ | $[C_6H_xN_y]_z$ |
|---|---|---|---|
| Reaction Behavior | vigorous reaction | vigorous reaction | less vigorous reaction |
| Carbon Residue | slight | much | none |
| Bath Behavior | strong foaming overflowing | slight foaming | slight foaming |
| Cyanide Content After Regeneration | 9.4% | 9.9% | 11.5% |
| Cyanate Content After Regeneration | 2.0% | 0.7% | 0.2% |
| Edge Oxidation (Metallographically) | strong | slight | none |
| Border Carbon Content of Subsequently Inserted Work Materials | | | |
| Theoretical value 0.8% | 0.5% | 0.7% | 0.8% |
| Theoretical value 1.1% | 0.6% | 0.8% | 1.1% |

The metallographically observed edge oxidation is in direct dependence on the cyanate content of the bath.

The process can comprise, consist essentially of, or consist of the stated steps with the recited materials; and the compositions can comprise, consist essentially of, or consist of the stated materials.

Unless otherwise indicated, all parts and percentages are by weight.

DETAILED DESCRIPTION

The following examples describe the production of the regeneration agent of the invention in more detail.

Small amounts of the regeneration agent of the invention can be produced as follows.

EXAMPLE 1

There are most intimately mixed 4.2 kg of dicyandiamide with 3.0 kg of paraformaldehyde. This mixture is heated in an iron crucible slowly to 400° C. with a blanket of nitrogen. There occurred a reaction with the splitting off of steam. There were contained in the steam small amounts of ammonia, hexamethylenetetramine, and hydrocyanic acid. The at first white, resinous swelled up reaction mass became increasingly darker with increasing temperature and when reaching 400° C. was black, brittle, and solid. It was mechanically crushed in the crucible and tempered further for 20 minutes at 450° C. This material had the formula $[C_6H_xN_y]_z$ where $\times$ is 3 to 5, y is 5 to 8, and z is 10 to 10,000. In the reaction, there was set free 1.8 kg of steam. The yield was 60% of theory.

EXAMPLE 2

The production was carried out industrially continuously in a reactor tube flushed with nitrogen and heated electrically to 400°–450° C. The mixture of dicyandiamide and paraformaldehyde in the mole ratio 1:2 was introduced automatically via an air lock into the reactor. The mixture reacted in the reactor after reaching the stated temperatures with the splitting off of 2 moles of steam and small amounts of $NH_3$, HCN, and hexamethylenetetramine, to the polymerizate $[C_6H_3N_y]_z$ where z is 10 to 10,000. This product was broken by an agitated shaft in the reactor and discharged in powder form via a second air lock.

The reaction gas for separation of solid particles carried along therewith was led over dust collecting chambers and finally into a torch flare.

The analysis of the compounds produced according to the above process is especially very difficult in the determination of z. The value of x fluctuates between 3 and 5 and the value of y between 5 and 8, depending on the production conditions. The value of z must be more or less estimated.

The following example illustrates the use of the regeneration agent of the invention.

EXAMPLE 3

There were melted in a crucible furnace 100 kg of a carburizing salt having the composition 40% $BaCl_2$, 50% $Na_2CO_3$, and 10% NaCN, and it was heated to 930° C. Because of the carburization of the batches inserted and through air oxidation, the cyanide content of this bath fell hourly and continuously around 0.15%. In normal operation, this bath after 24 hours only still contained 6.4% NaCN and no longer yielded optimal carburization results.

This reduction of the cyanide content was prevented by addition of 150 g/h of the regeneration agent of the invention since the carbonate formed in the oxidation of NaCN was changed back again through the regenerating agent into carburization active NaCN. In this manner, the optimal cyanide content of 10% NaCN can be maintained continuously.

The entire disclosure of German priority application P.3300488.9 is hereby incorporated by reference.

What is claimed is:

1. A process of regenerating a carburizing salt bath comprising regenerating the bath at a temperature of 800° to 950° C. by adding the polymeric organic compound of claim 1 thereto a polymeric compound having the over-all composition $(C_6H_xN_y)_z$, where x is 3 to 5 y is 5 to 8 z is 10 to 10,000.

2. A process according to claim 1 wherein the polymeric organic compound has the formula $[C_6H_3N_7]_z$.

3. A process according to claim 1 wherein the polymeric organic compound is prepared by reacting about 6 moles of formaldehyde with 3 moles of dicyandiamide, 6 moles of cyanamide, or 2 moles of melamine or a coresponding mixture of these compounds at 300° to 600° C. to form an initial resinous condensation product and subsequently subjecting the initial resinous condensation product to pyrolysis in the same temperature range.

4. A process according to claim 3 wherein in preparing the polymeric organic compound, there is employed dicyandiamide and the reaction and pyrolysis to form the polymeric organic compound are carried out at 400° to 500° C. for 10 to 60 minutes.

5. A process according to claim 1 wherein the carburizing salt bath comprises an alkali metal cyanide, an alkali metal carbonate, and barium chloride.

6. A process according to claim 5 wherein the alkali metal cyanide is sodium cyanide or potassium cyanide, and the alkali metal carbonate is sodium carbonate or potassium carbonate.

7. A process according to claim 6 wherein the carburizing bath consists essentially of sodium cyanide, sodium carbonate, and barium chloride.

8. A process according to claim 2 wherein z is 100 to 1000.

9. A process according to claim 1 wherein z is 100 to 1000.

* * * * *